US006477828B1

(12) United States Patent
Nölle

(10) Patent No.: US 6,477,828 B1
(45) Date of Patent: Nov. 12, 2002

(54) METHOD OF FALSE TWIST TEXTURING A SYNTHETIC YARN TO A CRIMPED YARN

(75) Inventor: Wolfgang Nölle, Ennepetal (DE)

(73) Assignee: Barmag AG, Remscheid (DE)

( * ) Notice: Subject to any disclaimer, the term of this patent is extended or adjusted under 35 U.S.C. 154(b) by 17 days.

(21) Appl. No.: 09/598,071

(22) Filed: Jun. 20, 2000

(30) Foreign Application Priority Data

Nov. 25, 1999 (DE) ..... 199 56 854

(51) Int. Cl.[7] ..... D02G 1/04
(52) U.S. Cl. ..... 57/332
(58) Field of Search ..... 57/204, 205, 226, 57/238, 239, 243, 244, 245, 246, 247, 282, 284, 332, 334, 337, 338, 339

(56) References Cited

U.S. PATENT DOCUMENTS

| | | | | |
|---|---|---|---|---|
| 3,501,904 A | | 3/1970 | Batsch | |
| 3,828,537 A | | 8/1974 | Doschko et al. | |
| 4,000,605 A | | 1/1977 | Chimura et al. | |
| 4,335,572 A | * | 6/1982 | Pope | 57/283 |
| 4,578,940 A | * | 4/1986 | Negishi et al. | 57/289 |
| 4,578,994 A | * | 4/1986 | Negishi et al. | 57/289 |
| 6,199,361 B1 | * | 3/2001 | Yakushi et al. | 57/332 |

FOREIGN PATENT DOCUMENTS

| | | | |
|---|---|---|---|
| CH | 525 297 | | 7/1972 |
| FR | 2 271 313 A1 | | 12/1975 |
| JP | 5-311527 | | 11/1993 |
| JP | 05311527 A | * | 11/1993 |

* cited by examiner

*Primary Examiner*—Danny Worrell
*Assistant Examiner*—Shaun R Hurley
(74) *Attorney, Agent, or Firm*—Alston & Bird LLP

(57) ABSTRACT

A method of false twist texturing a synthetic yarn as well the thus-produced crimped yarn. In the method, the yarn is irregularly drawn in a draw zone on a draw pin and subsequently textured in a false twist zone. As a result of the irregular drawing, an open and a closed combination of filaments is alternately produced in the crimped yarn, thus creating a crimped yarn, which exhibits a thin-thick effect.

12 Claims, 3 Drawing Sheets

METHOD OF FALSE TWIST TEXTURING A SYNTHETIC YARN TO A CRIMPED YARN

BACKGROUND OF THE INVENTION

The present invention relates to a method of false twist texturing a synthetic yarn to a crimped yarn, as well as the resulting crimped yarn.

To assimilate the characteristics of synthetic textile yarns to those of yarns from natural fibers, such as wool or cotton, it is known to improve the spun synthetic yarns in a texturing process. In this process, the synthetic filament strands, which form the yarn, are crimped, so that the yarn obtains a more textilelike appearance and the therewith connected characteristics. Such a process is known, for example, from JP 05311527 A, wherein the multifilament yarn is drawn in a draw zone with the aid of a heated draw pin, and subsequently, textured in a false twist zone. For producing the crimp, a false twist is produced in the yarn, which is set in the false twist zone by means of a heating device. Subsequently, the crimped yarn is wound to a package.

In the known method, a crimped yarn is produced, which has a very uniform structure with little bulk. As a result of hot drawing the filaments on the draw pin, a relatively closed combination of filaments is created, which results in little bulk and, thus, a low bulkiness of the crimped yarn. This imparts to thus-produced crimped yarns a more artificial appearance.

It is therefore an object of the invention to further develop the initially described method such that a crimped yarn is produced, which comes as close as possible to the character of natural fibers, as regards bulkiness, hand, and appearance.

SUMMARY OF THE INVENTION

The above and other objects and advantages of the present invention are achieved by the provision of a false twist texturing member wherein the synthetic yarn advances at a delivery speed $w_{1.1}$ and under a low absolute yarn tension $F_1$ of maximally 5 cN to a heated draw pin in a draw zone. In the draw zone, the yarn undergoes drawing by looping about the draw pin at a looping angle $\alpha<270°$, and it is withdrawn by a downstream feed system. In this process, the yarn tension $F_2$ in the yarn path downstream of the draw pin, is substantially greater than the yarn tension $F_1$ upstream of the draw pin. The feed system advances the yarn at a speed $w_1$ into the false twist zone. For purposes of drawing the yarn in the draw zone, this advancing speed $w_1$ is greater than the delivery speed $w_{1.1}$. In the false twist zone, the false twist is set at a temperature of more than 180° C. In this process, the yarn undergoes in the false twist zone a slight subsequent drawing. However, the withdrawal speed $w_2$ is not greater than 1.1 times the advancing speed $w_1$. Subsequently, the crimped yarn is wound to a package.

The method of the present invention is based on the recognition that the adjustment of the yarn tension in the draw zone upstream of the draw pin has a direct influence on the evenness of the drawing. Thus, it has been found that in particular in the case of low yarn tensions, the yarn is caused to flutter as it comes into contact with the draw pin. These flutters lead to an irregular thermal stress of the yarn on the draw pin and, thus, to an irregular drawing of the yarn. In this connection, use is made of the effects, in that as the yarn contacts the hot draw pin, the evaporating volatile components of the yarn exert forces on the draw pin. In relation to the low yarn tension, these forces are effective crosswise to the direction of the advancing yarn, and generate a fluttering motion of the yarn on the draw pin. After false twist texturing in the false twist zone, the uneven drawing and the irregular thermal stress of the yarn become effective in such a manner that the synthetic filaments intertwine irregularly, so that yarn lengths of a loose combination of filaments alternate with yarn lengths of a closed combination of filaments. In this connection, the loose combination of filaments forms a larger yarn cross section than the tight combination of filaments, so that a crimped yarn develops with a thick-thin effect.

To make the change of the filament combination in the crimped yarn reproducible, the yarn tension $F_2$ upstream of the feed system may be adjusted to a range from 0.5 cN/dtex to 1.2 cN/dtex for purposes of withdrawing the yarn from the draw zone.

During the drawing of the yarn, the draw pin is heated to a temperature ranging from about 80° C. to 160° C., preferably above 100° C. In this process, the yarn partially loops about the draw pin at an angle in the area of at least 90°. This makes it possible to influence the crystallinity of the filament strands, so that the differences in the filament combinations exhibit a high stability.

To make drawing uniform, the yarn undergoes a subsequent drawing in the false twist zone. In this connection, it is especially advantageous to adjust the subsequent drawing so that ratio $w_2/w_1$ is between about 1.03 to 1.06.

To ensure that the filament strands receive an adequate crimp even in the yarn lengths with a closed combination of filaments, a friction false twist unit with a plurality of friction disk has shown to be especially useful for producing the false twist on the yarn.

To produce less highly elastic crimped yarns, the yarn may undergo an aftertreatment by heating, after receiving the false twist and before being wound to the package, so as to enable a shrinkage of the yarn.

The method of the present invention makes it possible to produce a crimped yarn, which has characteristics that are otherwise known only from novelty yarns. The natural character of the yarn crimped according to the invention is especially enhanced by the changes in the filament combinations, which occur irregularly in sequence and size. The irregular yarn cross section of the crimped yarn according to the invention becomes even substantially more prominent in the dyeing of the filament yarn or in fabrics made therefrom. Not only do the yarn lengths with the open combination of filaments exhibit a color reproduction that is quite different from the yarn lengths with the closed combination of filaments, but the yarn lengths with a closed filament combination also exhibit a higher crystallinity than the yarn lengths with the open filament combination. With that, a structured dyeability is realized, which leads in a fabric to a uniform color structure. The different yarn segments may have a length from few millimeters to several centimeters.

Because of the yarn lengths with the open combination of filaments, such crimped yarns can be used for producing in an advantageous manner a composite yarn consisting of a plurality of individual yarns, for example, from different polymers. In this method, at least one of the yarns is textured in accordance with the invention, before being combined to the composite yarn. The thus-produced composite yarns distinguish themselves likewise by their natural character. It is preferred to combine the yarns by an air entanglement by means of an entanglement nozzle. In this process, an air jet is directed substantially crosswise to the yarn bundle, so that the filaments of the yarns intertwine.

To produce a crimped yarn of the present invention, an apparatus has proved to be especially useful which comprises a delivery system, a draw pin, a first feed system, a heating device, a cooling device, a false twist unit, a second feed system, and a take-up device. A yarn guide is arranged in the yarn path downstream of the draw pin, which is made adjustable for setting a predetermined looping angle of the yarn about the draw pin. With that, it is possible to adjust on the draw pin the characteristic, irregular draw ratio within a wide range by changing the looping of the yarn.

Preferably, the yarn guide is adjusted on an arcuate guideway, which is designed and constructed at a substantially constant distance from the circumference of the draw pin. With that, the yarn tensions adjusted in the draw zone remain substantially unchanged, even when the looping angle is changed.

BRIEF DESCRIPTION OF THE DRAWINGS

In the following, the method and the crimped yarn of the present invention are described in greater detail with reference to the accompanying drawings, in which.

DETAILED DESCRIPTION OF THE PREFERRED EMBODIMENTS

Figure 1:
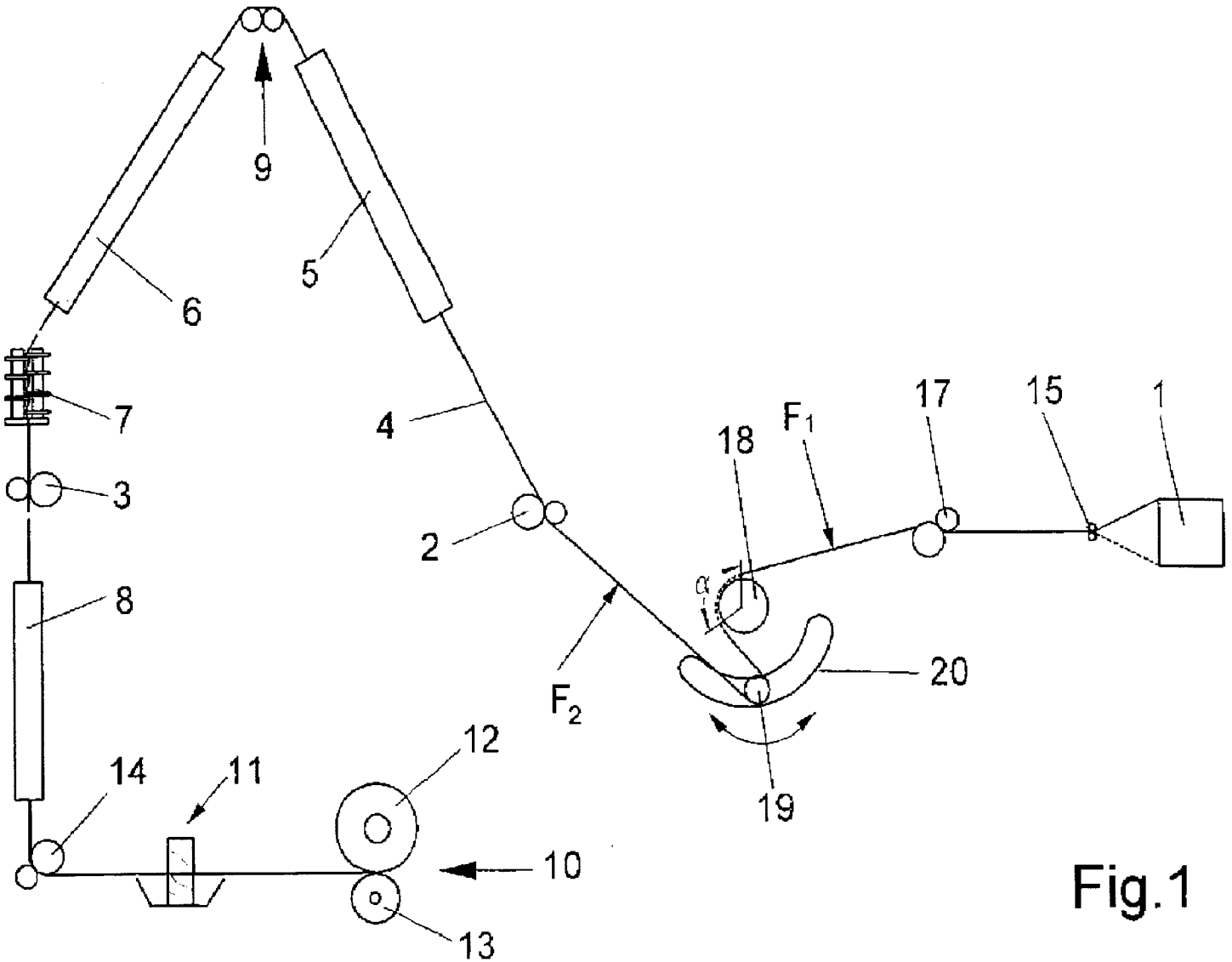
FIG. 1 illustrates a first embodiment of an apparatus for carrying out the method of the invention.

FIG. 1 is a schematic view of the apparatus according to the invention for carrying out the method of the invention. The apparatus comprises a delivery system 17, which withdraws a multifilament yarn 4 from a feed yarn package 1 via a yarn guide 15. The delivery system 17 is driven such that the yarn 4 advances at a delivery speed $w_{1.1}$ into a draw zone. Within the draw zone, which extends between the delivery system 17 and a downstream feed system 2, a heated draw pin 18 is arranged. The draw pin 18 is heated to a surface temperature in a range from about 80° C. to 160° C. The yarn 4 loops about the draw pin 18 at a looping angle in the area of at least about 90°. To this end, a yarn guide 19 is arranged on the delivery side of the draw pin 18. The yarn guide 19 is adjustable in a guideway 20 substantially parallel to the draw pin, so that it is possible to adjust on the draw pin a looping angle $\alpha$ from about 90° to 270°. After adjusting a looping angle, the yarn guide 19 is locked in its respective position, so that the yarn looping on the draw pin remains unchanged during the process.

From the draw zone, the yarn 4 is withdrawn by the feed system 2 downstream of the yarn guide 19, and advanced into a false twist zone that extends between the feed system 2 and a false twist unit 7. The false twist unit 7 produces a false twist on the yarn. In the present embodiment, the false twist unit 7 is designed and constructed as a friction disk unit that comprises a plurality of disks arranged on three shafts in such a manner that the disks overlap in a center region, through which the yarn advances. The friction disks operate at a circumferential speed, which amounts to about two times a withdrawal speed $w_2$ from the false twist zone. Within the false twist zone, a heater 5 and a cooling device 6 are arranged. Between the heater 5 and the cooling device 6, a yarn guide 9 is provided. The heater 5 is designed and constructed such that the yarn is heated to a temperature in a range from about 180° C. to 200° C. To this end, the heater may contain a heat transfer liquid, which heats a surface that is contacted by the yarn. However, it is also possible to operate the heater electrically at a temperature above the melt point of the yarn material. In this instance, the yarn is guided at a distance from the heating surface.

Downstream of the heater 5, the cooling device 6 extends, which cools the yarn to a temperature from about 80° C. to 100° C. The cooled yarn advances through the false twist unit 7. Subsequently, the second feed system 3 withdraws the yarn 4 from the false twist zone at a withdrawal speed $w_2$. A subsequent drawing in the false twist zone is however limited and does not exceed the speed ratio formed by the withdrawal speed and delivery speed of $w_2/w_1=1.1$, and preferably is in the range of $w_2/w_1=1.03$ to 1.06.

To produce a high-elasticity crimped yarn, the yarn could be wound to a package in a take-up device 10 downstream of the second feed system 3. In the apparatus shown in FIG. 1, an aftertreatment of the yarn 4 is provided. To this end, a second heater 8 is arranged downstream of the second feed system 3. In the heater 8, the yarn undergoes a subsequent heat treatment for equalizing tension or for treating shrinkage. The yarn 4 is withdrawn from the heater 8 by a third feed system 14, and after being lubricated in a lubrication device 11, it is wound to a package 12 in the take-up device 10. To this end, the package 12 is driven a by drive roll 13 at a constant circumferential speed. The package 12 holds the crimped yarn of the present invention.

In the production of the crimped yarn, the yarn path is adjusted in the draw zone between the delivery system 17 and the first feed system 2 in such a manner that the yarn length between the delivery system 17 and the draw pin 8 is adjusted to a very low tension $F_1$, which is in a range of less than about 5 cN. However, in the yarn length between the adjustable yarn guide 19 and the first feed system 2, the full yarn tension $F_2$ is effective, which ranges from about 0.5 cN/dtex to 1.2 cN/dtex. This adjustment according to the invention allows to realize on the draw pin 18 an irregular drawing and thermal stress of the yarn 4. The advancing speed $w_1$ is adjusted with respect to the delivery speed $w_{1.1}$ to the ratio $w_1/w_{1.1}=1.5$ to 1.7, so that the yarn 4 is drawn. While the crimp is set, a slight subsequent drawing occurs in the false twist zone. To this end, the withdrawal speed $w_2$ of the second feed system 3 is adjusted insignificantly higher than the advancing speed $w_1$ of the first feed system. In this instance, the speed ratio is preferably at $w_2/w_1=1.03$ to 1.06. The method of the present invention is suitable for producing high-elasticity yarns or set yarns from polyester, polyamide, or polypropylene. In this connection, the feed yarns may be spun POY yarns in the range from 50 to 200 dtex with 1.5 to 2 dpf.

Figure 2:
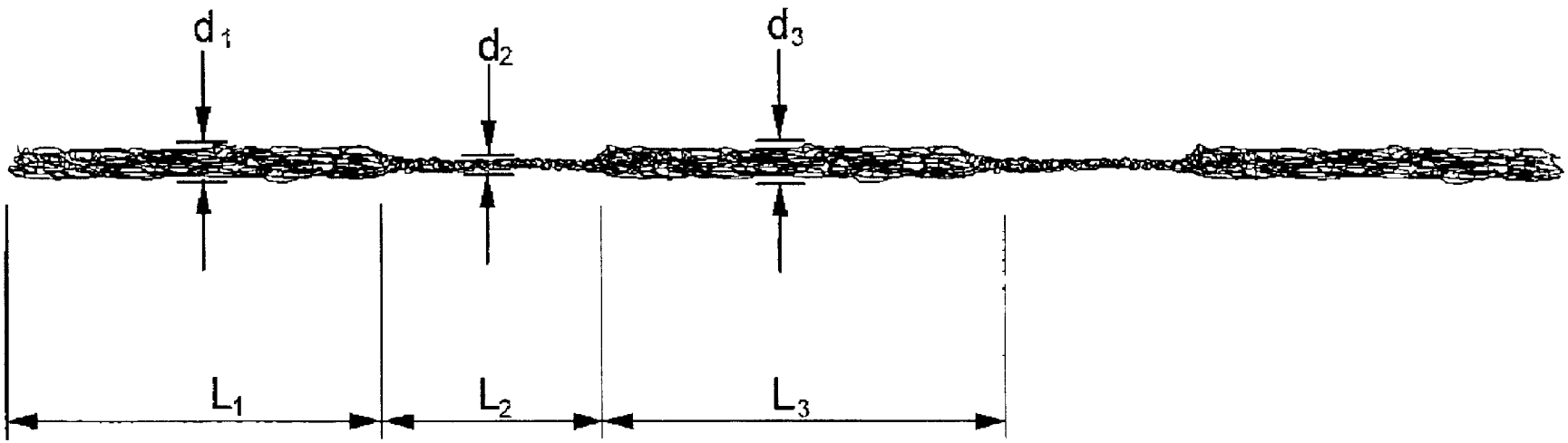
FIG. 2 is a schematic view of the crimped yarn.

FIG. 2 is an illustration of the crimped yarn according to the invention. The crimped yarn is formed by a plurality of filaments. When related to the yarn length, the synthetic filaments intertwine irregularly, so that open and closed yarn cross sections alternate with one another, which develop after false twist texturing as a result of differences of the crystallinity in the filament strands. In FIG. 2, the yarn cross sections are indicated at $d_1$, $d_2$, and $d_3$. The associated yarn segments are shown in FIG. 2 at the lengths $L_1$, $L_2$, and $L_3$. The filaments in the segment $L_1$ form a relatively open combination of filaments with the yarn cross section $d_1$. In the adjacent yarn length $L_2$, the filaments intertwine to a closed combination of filaments with the smaller diameter $d_2$. This alternation repeats itself, so that the yarn length $L_3$ adjacent the yarn length $L_2$ shows a relatively open filament combination with the yarn cross section $d_3$. Depending on the adjustment of the yarn tension, the looping angle on the draw pin, the yarn speeds, and the temperature adjusted on the draw pin and in the heater, the yarn lengths $L_1$, $L_2$, and $L_3$ may extend over a length of some few millimeters to several centimeters. The size of the yarn cross sections and the distribution of the lengths are irregular, so that the crimped yarn exhibits an irregular surface structure, which compares to a thick-thin novelty yarn. The crimped yarn of the present invention is therefore especially suited for producing fabrics with color structures.

Figure 3:
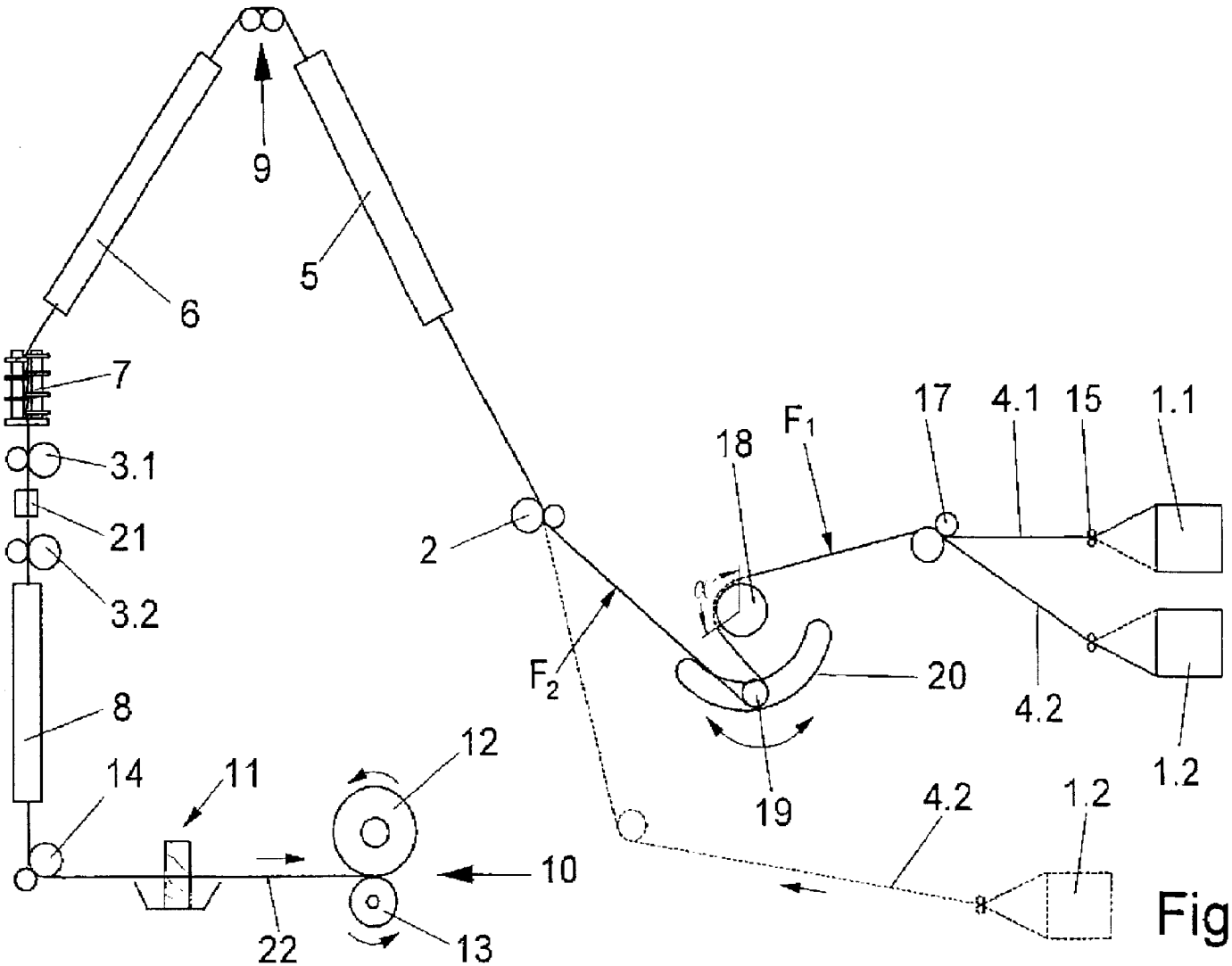
FIG. 3 illustrates an apparatus for producing a composite yarn by the method of the present invention.

FIG. 3 is a schematic view of an embodiment of an apparatus for producing a composite yarn by the method of the present invention. The apparatus is substantially identical with the apparatus shown in FIG. 1. To this extent, the foregoing description is herewith incorporated by reference, and only differences of the apparatus of FIG. 3 are described.

In the apparatus shown in FIG. 3, the delivery system 17 withdraws two yarns 4.1 and 4.2 from their respective feed yarn packages 1.1 and 1.2. The yarns 4.1 and 4.2 advance parallel side by side into a draw zone. Within the draw zone, the yarns 4.1. and 4.2 are drawn by means of the heated draw pin 18. To adjust the looping angle of the yarns on the draw pin 18, a yarn guide 19 is arranged downstream of the draw pin 18. This yarn guide 19 is adjustable within a guideway 20 substantially parallel to the draw pin. A downstream feed system 2 withdraws the yarns 4.1 and 4.2 from the draw zone and advances them into a false twist zone. The false twist zone includes a heater 5, a cooling device 6, as well as a false twist unit 7. The units in the false twist zone are constructed as double units, so that the yarns 4.1 and 4.2 are textured parallel side by side. Subsequently, a feed system 3.1 withdraws the yarns 4.1 and 4.2 from the false twist zone. Thereafter, the yarns 4.1 and 4.2 are combined to a composite yarn 22. To this end, the yarns 4.1 and 4.2 advance through an entanglement nozzle 21, and are subjected to a substantially transversely directed air pressure.

A feed system 3.2 downstream of the entanglement nozzle 21 advances the composite yarn into an aftertreatment zone. In this zone, the composite yarn 22 is heated in a heater 8 for purposes of equalizing in this way inner tensions. From the heater 8, the composite yarn 22 is withdrawn by a further feed system 14, and, after having been lubricated in a lubrication device 11, it is wound to a package 12 in a take-up device 10.

For drawing and for false twist texturing, the yarn guidance is identical with that in the apparatus described with reference to FIG. 1. Therefore, as regards the method steps and adjustment of the units of FIG. 3, the foregoing description of FIG. 1 is herewith incorporated by reference.

Contrary to the foregoing embodiment, the apparatus of FIG. 3 is suitable for texturing a plurality of yarns at the same time, and to combine them thereafter to a composite yarn. The number of the yarns in FIG. 3 is exemplary. It is likewise possible to produce a composite yarn in such a manner that one of the yarns advances directly into the false twist zone. FIG. 3 illustrates this situation in phantom lines. In this instance, the yarn 4.2 is withdrawn from the feed yarn package 1.2 by the feed system 2, and advanced into the false twist zone. The second yarn 4.1, however, advances through the draw zone before being textured.

A thus-produced composite yarn exhibits a relatively small thick-thin effect.

What is claimed is:

1. A method of false twist texturing a synthetic yarn comprising the steps of:

delivering the yarn at a speed $w_{1.1}$ and under an absolute yarn tension $F_1$ not greater than about 5 cN, to a heated draw pin in a draw zone;

drawing the yarn by looping it about the draw pin at a looping angle $\alpha<270°$, and withdrawing the yarn under a tension $F_2$, which is greater than the yarn tension $F_1$ upstream of the draw pin;

advancing the yarn into a false twist zone at an advancing speed $w_1$, which is greater than the withdrawal speed $w_{1.1}$;

heating the yarn with a false twist to a temperature T>180° C., and subsequently cooling the yarn with a false twist within the false twist zone;

guiding the yarn through a false twist unit at the downstream end of the false twist zone and so as to impart a false twist to the yarn in the false twist zone;

withdrawing the yarn from the false twist zone at a withdrawal speed $w_2$ so as to impart a subsequent drawing to the yarn in the false twist zone; and winding the yarn to a package.

2. The method of claim 1 wherein the withdrawal speed $w_2$ is not greater than about 1.1 times the advancing speed $w_1$.

3. The method of claim 2 wherein the withdrawal speed $w_2$ is above 400 m/min.

4. The method of claim 2, wherein the yarn tension $F_2$ upstream of the feed system for withdrawing the yarn from the draw zone ranges from 0.5 cN/dtex to 1.2 cN/dtex.

5. The method of claim 2, wherein the draw pin is heated to a temperature ranging from about 80° C. to about 160°, and that the yarn partially loops about the draw pin at a looping angle of at least about 90°.

6. The method of claim 5 wherein for drawing the yarn in the draw zone, a speed ratio formed between the advancing speed $w_1$ and the delivery speed $w_{1.1}$ is >1.4.

7. The method of claim 2, wherein for subsequently drawing the yarn in the false twist zone, the speed ratio formed between the withdrawal speed $w_2$ and the advancing speed $w_1$is between about 1.03 to 1.06.

8. The method of claim 2, wherein the false twist is produced on the yarn by a false twist unit which comprises a plurality of friction disks.

9. The method of claim 8, wherein after receiving a false twist and before being wound a the package, the yarn undergoes an aftertreatment which includes heating.

10. The method of producing a composite yarn, which is formed from at lest two feed yarns, wherein at least one of the yarns is false twist textured before being combined by the method according to claim 1.

11. The method of claim 10, wherein directly after being withdrawn from their respective feed yarn package, the yarns are advanced together into the false twist zone so as to be false twist textured together.

12. The method of claim 11, wherein the yarns are combined by air entanglement within an entanglement nozzle directly after being false twist textured.

* * * * *